United States Patent [19]

De Fries

[11] 4,298,103

[45] Nov. 3, 1981

[54] COMBINATION PORTABLE STORAGE CONTAINER AND HEAD REST

[76] Inventor: Donald De Fries, 5223 North Oakview, Chicago, Ill. 60656

[21] Appl. No.: 139,904

[22] Filed: Apr. 14, 1980

Related U.S. Application Data

[63] Continuation-in-part of Ser. No. 937,894, Aug. 29, 1978, Pat. No. 4,222,468.

[51] Int. Cl.[3] ..... A45C 3/10

[52] U.S. Cl. ..... 190/42; 5/440

[58] Field of Search ..... 150/35; 190/42; 5/434, 5/436, 440, 491

[56] References Cited

U.S. PATENT DOCUMENTS 2,293,530 8/1942 Beehler ..... 190/42

3,263,246 8/1966 Towery ..... 190/42 X

*Primary Examiner*—Donald F. Norton

*Attorney, Agent, or Firm*—Bernard L. Kleinke

[57] ABSTRACT

A combination portable storage container and head rest includes an inner rigid member, which has an opened top cylindrical body portion. The body portion has a rigid bottom wall and is composed of tapered stock material. The rigid member further includes a rigid collar surrounding the opened-top end of the body portion to help rigidify it. The collar includes a relatively wide flat annular surface which facilitates the supporting of the user in a seated position when the unit is disposed in an upright position.

9 Claims, 3 Drawing Figures

COMBINATION PORTABLE STORAGE CONTAINER AND HEAD REST

This is a continuation-in-part of copending patent application Ser. No. 937,894, filed Aug. 29, 1978, now U.S. Pat. No. 4,222,468, for "COMBINATION PORTABLE STORAGE CONTAINER AND HEAT REST", in which is disclosed a device which serves as a cushion or head rest and which has interior storage facilities. The combination

DESCRIPTION

1. Technical Field

The present invention relates in general to a combination portable container and head rest, and more particularly relates to a cushion or head rest having storage facilities contained at the interior thereof, which head rest is particularly well adapted for use at the beach or at other leisure activities.

2. Background Art

The combination storage container and head rest is particularly well suited for leisure activities, such as taking it to the beach. The device includes an interior storage container to enable the user to remove the smaller container and carry valuables while leaving the rest of the unit temporarily therebehind. While such a unit is satisfactory for many applications, it is highly desirable to be able to enable the unit to stand in an upright position and serve as a seat, whereby the unit can serve the added function of supporting the user in a seated position. Additionally, it would be highly desirable to have such a unit which is relatively less expensive to manufacture, and yet be relatively sturdy in construction and enable the interior of the unit to be relatively watertight, so that chilled beverage containers may be stored therein and so that the unit can be made buoyant for relatively long periods of time in the water.

Therefore, the principal object of the present invention is to provide a new and improved combination portable storage container and head rest, which also serves as a seat to support the user in a seated position.

Another object of the present invention is to provide such a new and improved combination portable storage container and head rest, which has a relatively watertight interior compartment, and which is relatively less expensive to manufacture.

Briefly, the above and further objects of the present invention are realized by providing a combination portable storage container and head rest, which includes an inner rigid member, which has an opened top cylindrical body portion. The body portion has a rigid bottom wall and is composed of paper stock material. The rigid member further includes a rigid collar surrounding the opened-top end of the body portion to help rigidify it. The collar includes a relatively wide flat annular surface which facilitates the supporting of the user in a seated position when the unit is disposed in an upright position.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
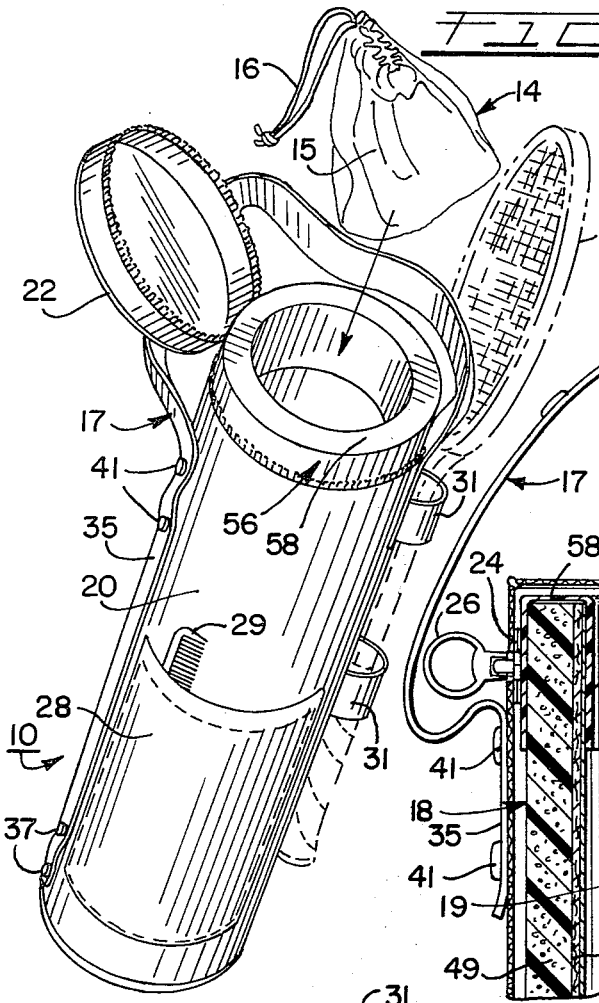
FIG. 1 is a pictorial view of a combination portable storage container and head rest, which is constructed in accordance with the present invention and which is shown in its open position.
Figure 2:
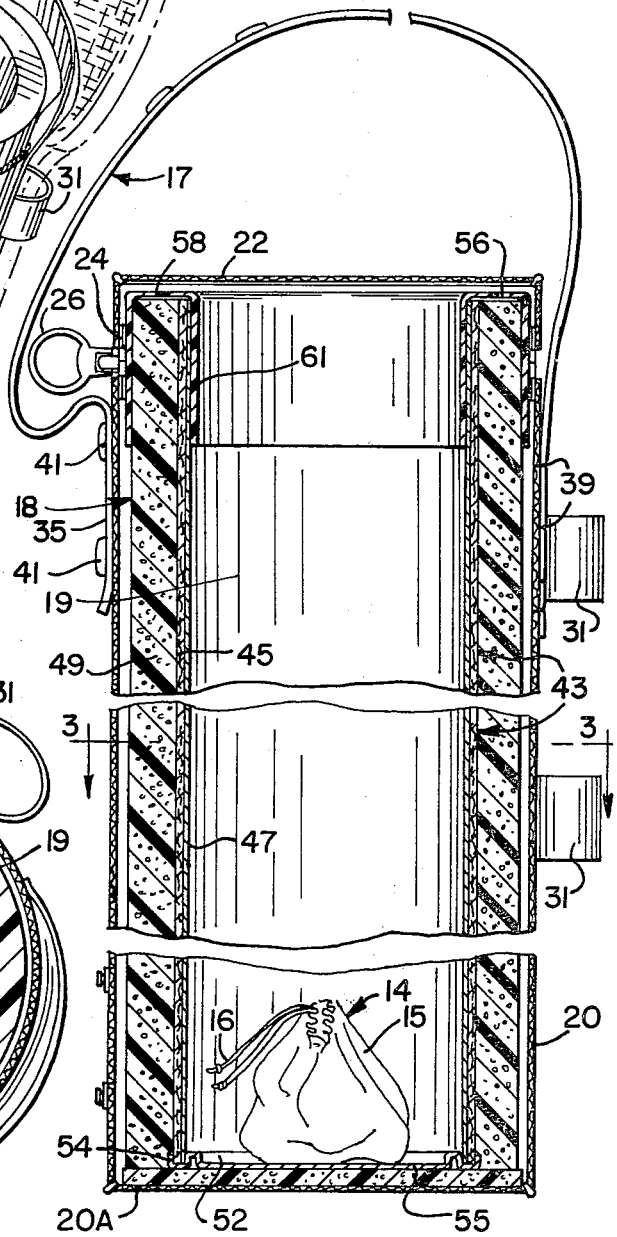
FIG. 2 is an enlarged longitudinal cross-sectional view of the unit of FIG. 1.

Referring now to the drawings, and more particularly to FIG. 1 thereof, there is shown a combination portable storage container and head rest 10, which is constructed in accordance with the present invention and which is shown disposed in its open position receiving a smaller container 14. The smaller container 14 is in the form of a bag 15 having a draw string closure 16 and is adapted to be disposed within the unit 10 as shown in FIG. 2 of the drawings. In this manner, valuables can be stored in the smaller container 14 so that the user, for example, can leave the remaining portion of the unit at the recreational area and carry the valuable items in the container 14.

A fabric loop handle 17 is disposed at the top end portion of the unit 10 for carrying purposes. A hollow foam elongated insert 18 has a large hollow compartment 19 extending throughout its length for receiving the smaller container 14 as well as other items to be stored therein, such items including beach towels, food items, recreational equipment and the like. A smooth fabric cover 20 extends entirely over the insert 18 to provide a finished appearance for the unit 10 and includes an end flap 22 which is secured in its closed position by means of a slide fastening device 24 having a pull ring 26. An outer pocket 28 is disposed on and sewn to the outer surface of the cover 20 near the bottom end portion thereof for receiving and storing numerous items, such as the comb 29. On the side of the cover 20, a pair of axially spaced-apart flexible fabric loops 31 receive and support a tennis racket 33 or the like so that such a device can be conveniently carried with the unit 10.

Considering now the handle 17 in greater detail with particular reference to FIGS. 1 and 2 of the drawings, the handle 17 includes a strap 35 of fabric material, which is attached at one of its ends by means of a pair of axially spaced-apart lower snap-fastening devices 37 at the lower end portion of the unit 10 and at its opposite end by means of stitching 39, so that the strap 35 extends outwardly beyond the top end of the unit 10 when it is used to carry the unit 10. A pair of upper axially spaced-apart intermediate snap-fastening devices 41 enable the free end portion of the strap to be attached at the upper location by means of the snap-fastening devices 41 so as to effectively increase the size of the handle as shown in FIG. 2 of the drawings, whereby the unit 10 may be supported by and hung from the shoulder of the user.

In use, the novel unit 10 may be used to carry numerous different items within the hollow compartment 19, and the valuable items are carried in the container or bag 14 disposed within the hollow compartment 19. Other items, such as the comb 29, are stored externally within the pocket 28. A piece of athletic equipment, such as the tennis racket 33, is positioned within the loops 31 for carrying purposes. Additionally, the hollow compartment 19, as hereinafter described in greater detail, is substantially watertight, and therefore the unit 10 can be used to refrigerate perishable comestibles by placing a chemical gel-type of refrigerating device (not shown) within the hollow compartment 19 to help refrigerate comestible items (not shown) stored therein.

The unit 10 may be placed on its side on the ground, such as at a sandy beach area, to serve as a head rest, since the foam insert 18 is sufficiently soft and resilient to support comfortably the head of the user. The unit 10 also may be positioned on its bottom end in an upright manner on the ground to serve as a seat, and in this regard, the user may sit down on the top end of the unit 10 due to the sturdy but light-weight construction of the unit 10.

Figure 3:
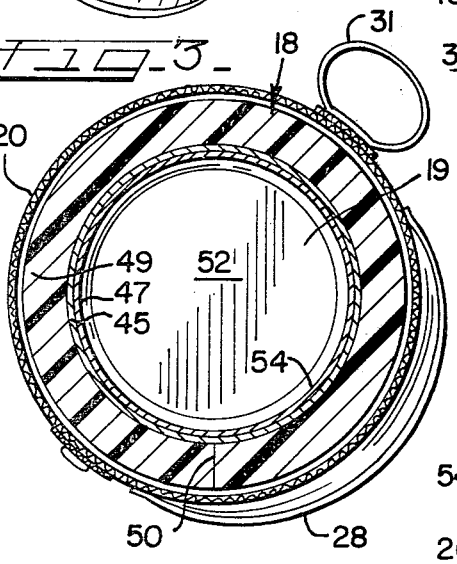
FIG. 3 is a transverse cross-sectional view of the unit of FIG. 2 taken substantially along the line 3—3 thereof.

Considering now the hollow foam elongated insert 18 in greater detail, with particular reference to FIGS. 2 and 3 of the drawings, the insert 18 includes a tubular member 43, which is hollow throughout its length and open at both ends. The tubular member 43 is generally cylindrical in shape and circular in cross section throughout its length. The tubular member 43 generally comprises a rigid body or core portion 45 which is preferably composed of stock material, and which is hollow throughout its length, being open at both ends. The body portion 45 is circular in cross section throughout its length. By employing paper stock material, the unit 10 is light in weight and less expensive to manufacture. A foil lining 47 on the inside of the body portion 45 is preferably composed of aluminum foil and enables the unit to be substantially watertight. The foil lining 47 may be fixed in place by any suitable technique such as by applying a suitable adhesive between the foil lining 47 and the body portion 45 surrounding it concentrically.

Surrounding the body portion 45, there is a soft resilient tubular member 49, which is hollow throughout its length and which is generally circular in cross sectional area throughout its length. The resilient tubular member 49 surrounds concentrically the rigid tubular member 43 to provide the unit 10 with an internal padding so that the unit 10 can serve as a head rest. The resilient tubular member 49 is preferably composed of a foam plastic material such as polyurethane foam material. As best seen in FIG. 3 of the drawings, the resilient tubular member 49 is in the form of a rectangular sheet which is formed into a tubular configuration as shown in the drawings. In this regard, the sheet of foam plastic material is wrapped about the outer periphery of the rigid tubular member 43, and the edges are butted together at 50 to form the tubular configuration as shown in the drawings. The foam member 49 is fixed in place on the outer surface of the rigid tubular member 43 by any suitable technique such as by applying a suitable adhesive between the resilient tubular member 49 and the inner rigid tubular member 43.

A bottom wall 52 is composed of metal material and has an upwardly facing annular groove 54 which receives the bottom edge of the rigid tubular member 43. The bottom wall 52 is crimped fixedly in position to form a substantially watertight seal.

A circular disc 55 is composed of soft resilient foam plastic material, such as polyurethane foam material, and overlies the outer surface of the bottom wall 52 on the inside of the cover 20 at the end portion 20A thereof to provide a finished appearance for the unit 10.

A collar 56 is composed of rigid material, such as molded plastic material. The rigid collar 56 fits on and surrounds the upper end of the rigid tubular member 43 and the outer flexible tubular member 49. As best seen in FIGS. 1 and 2 of the drawings, the collar 56 includes a wide flat upper surface 58, which enables the user to sit on the unit 10, preferably when the end flap 22 is in its closed position over the collar 56. As best seen in FIG. 2 of the drawings, the collar 56 includes a downwardly depending annular channel-shaped skirt portion 61 which receives the upper end portion of the inner rigid tubular member 43 and the outer flexible tubular member 49.

The rigid one-piece molded plastic collar 56 extends axially downwardly by a substantial distance along the outside of the inner tubular members for rigidifying them. In this regard, the unit is greatly strengthened by the collar 56 for the purpose of facilitating the carrying of heavy objects, such as beverage containers, within the inner compartment 19. The collar 56 also greatly strengthens the light-weight unit 10 to enable a person to sit on the unit 10 when the unit 10 is disposed in its upright position with the collar 56 located at the top end of the unit 10.

While a particular embodiment of the present invention has been disclosed, it is to be understood that various different modifications are possible and are contemplated within the true spirit and scope of the appended claims. For example, the covering 20 is preferably composed of a nylon fabric material, but it may be composed of many different types and kinds of materials. There is no intention, therefore, of limitations to the exact abstract or disclosure herein presented.

I claim:

1. In a combination portable storage container and head rest, a hollow elongated rigid tubular member, an elongated outer resilient tubular member axially aligned with and surrounding said inner rigid member, an elongated covering enclosing said outer resilient member, said covering having openable means for permitting access to the interior of said hollow elongated rigid tubular member, the combination comprising: said rigid member having an opened top cylindrical body portion, said body portion having a rigid bottom wall, said cylindrical body portion being composed of paper stock material, said rigid member including a rigid collar surrounding the opened-top end of said body portion.

2. In a combination portable storage container and head rest, the combination according to claim 1, wherein said rigid collar includes a relatively wide flat annular surface.

3. In a combination portable storage container and head rest, the combination according to claim 2, wherein said collar includes said surface being a bight portion of an annular channel-shaped member.

4. In a combination portable storage container and head rest, the combination according to claim 3, wherein said rigid collar is composed of molded one-piece plastic material.

5. In a combination portable storage container and head rest, the combination according to claim 4, wherein said body portion includes an inner foil lining.

6. In a combination portable storage container and head rest, the combination according to claim 1, wherein said cylindrical body portion is a thin-walled tube.

7. In a combination portable storage container and head rest, the combination according to claim 6, wherein said body portion includes a bottom wall crimped sealingly in place at the bottom end portion of the cylindrical body portion.

8. In a combination portable storage container and head rest, the combination according to claim 7, wherein said bottom wall is composed of metal material and has an annular groove receiving the bottom edge of said body portion and being crimped in place.

9. In a combination portable storage container and head rest, the combination according to claim 8, wherein said covering includes a pair of axially spaced-apart flexible loops adapted to receive and support a piece of athletic equipment, a pocket mounted on the outside of said covering, said openable means being a flap, a slide fastening device for fixing releasably said flap in a closed position over said rigid collar.

* * * * *